US005252944A

United States Patent [19]

Caddock, Jr.

[11] Patent Number: 5,252,944

[45] Date of Patent: Oct. 12, 1993

[54] FILM-TYPE ELECTRICAL RESISTOR COMBINATION

[75] Inventor: Richard B. Caddock, Jr., Winchester, Oreg.

[73] Assignee: Caddock Electronics, Inc., Riverside, Calif.

[21] Appl. No.: 863,834

[22] Filed: Apr. 6, 1992

Related U.S. Application Data

[63] Continuation-in-part of Ser. No. 758,596, Sep. 12, 1991.

[51] Int. Cl.[5] ..... H01C 1/034

[52] U.S. Cl. ..... 338/275; 338/260; 338/256; 338/309; 338/317; 338/273; 338/333; 257/675

[58] Field of Search ..... 338/275, 230, 260, 232, 338/273, 333, 256, 309, 195-317; 174/52.2; 257/675, 716, 717, 796, 676, 670

[56] References Cited

U.S. PATENT DOCUMENTS

| | | | |
|---|---|---|---|
| 3,441,895 | 4/1969 | Schwartz | 338/256 |
| 3,638,161 | 1/1972 | Dumas | 338/256 |
| 3,649,944 | 3/1972 | Caddock | 338/260 |
| 3,722,085 | 3/1973 | Caddock | 29/620 |
| 3,772,452 | 4/1973 | Usowski | 174/52.2 |
| 4,064,477 | 12/1977 | Thompson | 338/51 |
| 4,510,519 | 4/1985 | Dubois et al. | 257/117 |
| 4,583,283 | 4/1986 | Dubois et al. | 257/675 X |
| 4,589,010 | 5/1986 | Tateno et al. | 257/670 |
| 4,788,524 | 11/1988 | Ozaki | 338/309 |
| 5,019,893 | 5/1991 | Frank et al. | 257/717 |

FOREIGN PATENT DOCUMENTS

| | | |
|---|---|---|
| 0028994 | 11/1980 | European Pat. Off. . |
| 0334473 | 2/1989 | European Pat. Off. . |
| 8809809 | 8/1988 | Fed. Rep. of Germany . |
| 61-150354 | 7/1986 | Japan . |
| 63-205935 | 8/1988 | Japan . |
| 2050705 | 5/1979 | United Kingdom . |

OTHER PUBLICATIONS

Caddock Electronics, Inc. General Catalog 23rd Edition, 1989, pp. 17-21.

Motorola Catalog: 1989 Full Pak Power Semiconductors for Isolated Package Applications.

Pages 6-18 and 1-134 of Motorola Catalog entitled Bipolar Power Transistor and Thyristor Data.

Data Sheet No. PD-2.068A from International Rectifier 1985 Product Guide and Specification Databook.

*Primary Examiner*—Marvin M. Lateef

*Attorney, Agent, or Firm*—Richard L. Gausewitz

[57] ABSTRACT

The film-type electrical power resistor includes a flat chip of aluminum oxide, having a resistive film screen-printed onto one of its sides. Leads are bonded to that side and electrically connected to the film, the leads being such that the chip may be cantilevered by the leads in a mold cavity before introduction of synthetic resin into the cavity, and with the lower chip surface spaced above the bottom cavity wall. A molded body is molded in the cavity to fully encapsulate the chip, film, and inner ends of the leads, there being no mold cup around the molded body. The molded body is formed of high thermal-conductivity thermosetting synthetic resin. Provided through the body is a bolthole for clamping of the resistor to an external chassis or heat-sink. The space between the bottom surface of the chip and the flat bottom surface of the molded body is a heat-sinking volume formed of the high thermal-conductivity resin; and the bottom surface of such volume of resin is the bottom surface of the resistor. The stated volume does not contain any metal that is either in an electric circuit, or projects outwardly relative to the edges of the chip.

20 Claims, 4 Drawing Sheets

FIG. 2.
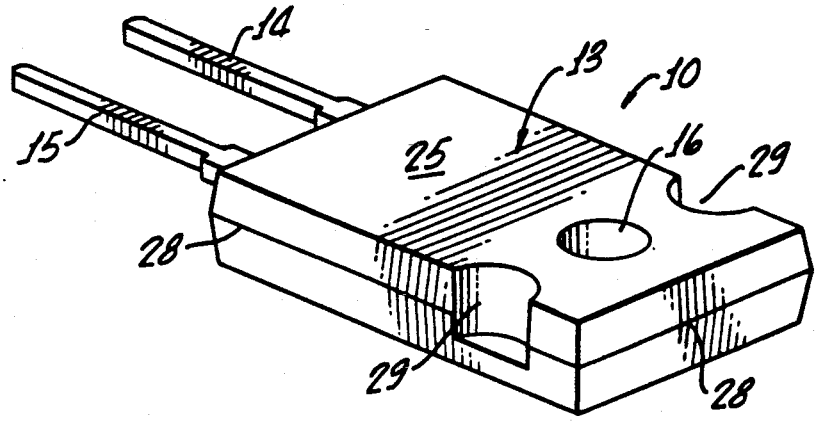
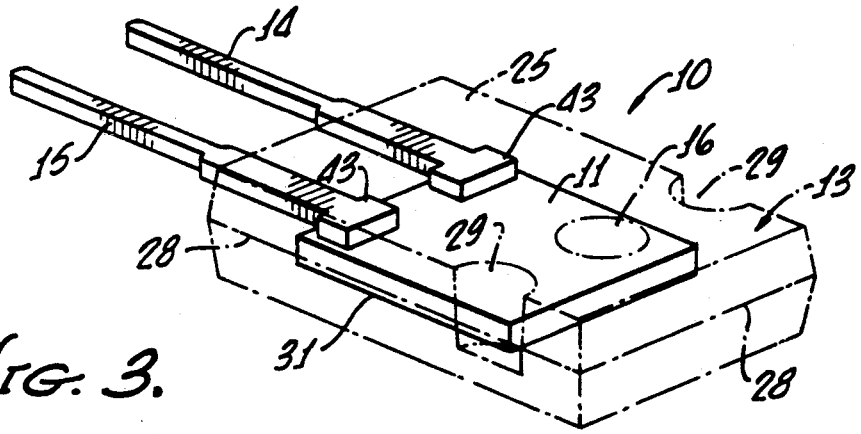
FIG. 3.
FIG. 4.
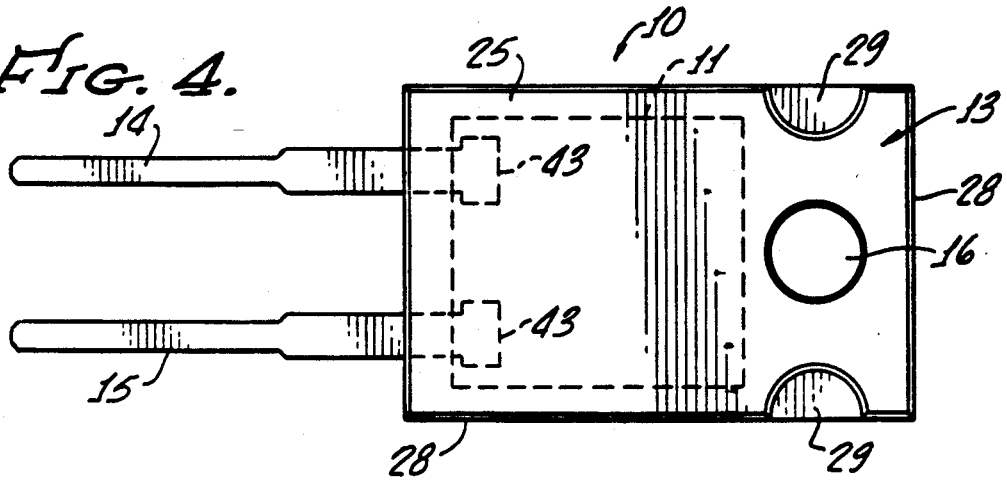

FILM-TYPE ELECTRICAL RESISTOR COMBINATION

CROSS REFERENCE TO RELATED APPLICATION

This is a continuation-in-part of application Serial No. 758,596, filed Sept. 12, 1991, for Film-Type Electrical Resistor Combination.

BACKGROUND OF THE INVENTION

For many years, the assignee of the present patent application has made and sold large numbers of flat film-type power resistors that are fully encapsulated in a silicone molding compound. These resistors are free-standing, not being mounted in engagement with any chassis (heatsink). Thus, with such resistors, there is no danger of shorting through or arcing to the chassis. The indicated free-standing power resistors that have long been sold by applicant's assignee have power ratings of either 0.5 watt or 0.75 watt. One such free-standing power resistor is shown in FIG. 8. A transfer-molded silicone body is shown in phantom lines. An aluminum oxide ceramic chip is the back element (in the drawing), and has a back surface spaced from the back surface of the silicone body. On the front of the chip are screen-printed traces, resistive film and glass. The indicated leads are soldered to the traces.

The present resistor combination has a power rating of 15 watts, yet the physical size of the resistor (surface area of one of the two parallel sides of the entire resistor) is only a little over three times that of the indicated 0.75 watt free-standing resistor.

SUMMARY OF THE INVENTION

It has now been conceived that a relatively high-power, yet physically small, flat film-type resistor may be bolted in close heat-transfer relationship to a chassis, without danger of shorting through or arcing to such chassis. This is accomplished without use of any heat-sink in the resistor, and without any electrical insulators other than the chip that forms the substrate for the resistive film, and other than high thermal-conductivity synthetic resin in which the chip and film are molded.

The resistor is bolted closely to the chassis by using a bolthole provided in an elongate synthetic resin body. It is a major feature of the invention that the combination thus resulting is one where the resistive film is remote from the chassis. Thus, the orientation is such that the substrate is between the film and chassis, thereby serving as an electrical insulator in addition to performing its substrate function. In the vast majority of cases there is also substantial synthetic resin between the resistive film and the chassis; however, should a molding malfunction result in a resistor where there is only very little resin below the chip, there is still adequate dielectric strength between film and chassis.

The relationships are such that the substrate not only electrically insulates the resistive film from the chassis—while effecting major heat transfer from film to chassis—but the leads are likewise spaced from the chassis so as not to create any arcing or shorting problem.

It is not required, and not desired, that any electrical insulator other than the chip and the synthetic resin be between the resistive film and the chassis.

The present power resistor combination is low in cost, and is well suited to numerous high-volume applications. Another of its advantages is that the high thermal-conductivity synthetic resin is quite forgiving relative to burrs on the chassis. Thus, the bolt that holds the resistor to the chassis may be tightened very significantly without danger that the substrate will break.

BRIEF DESCRIPTION OF THE DRAWINGS

FIG. 2 is an isometric view illustrating the exterior of the resistor;

FIG. 3 corresponds to FIG. 2 but illustrates interior components of the resistor, the resistive film not being shown;

FIG. 4 is a top plan view of FIG. 2;

DESCRIPTION OF THE PREFERRED EMBODIMENT OF THE INVENTION

Figure 1:
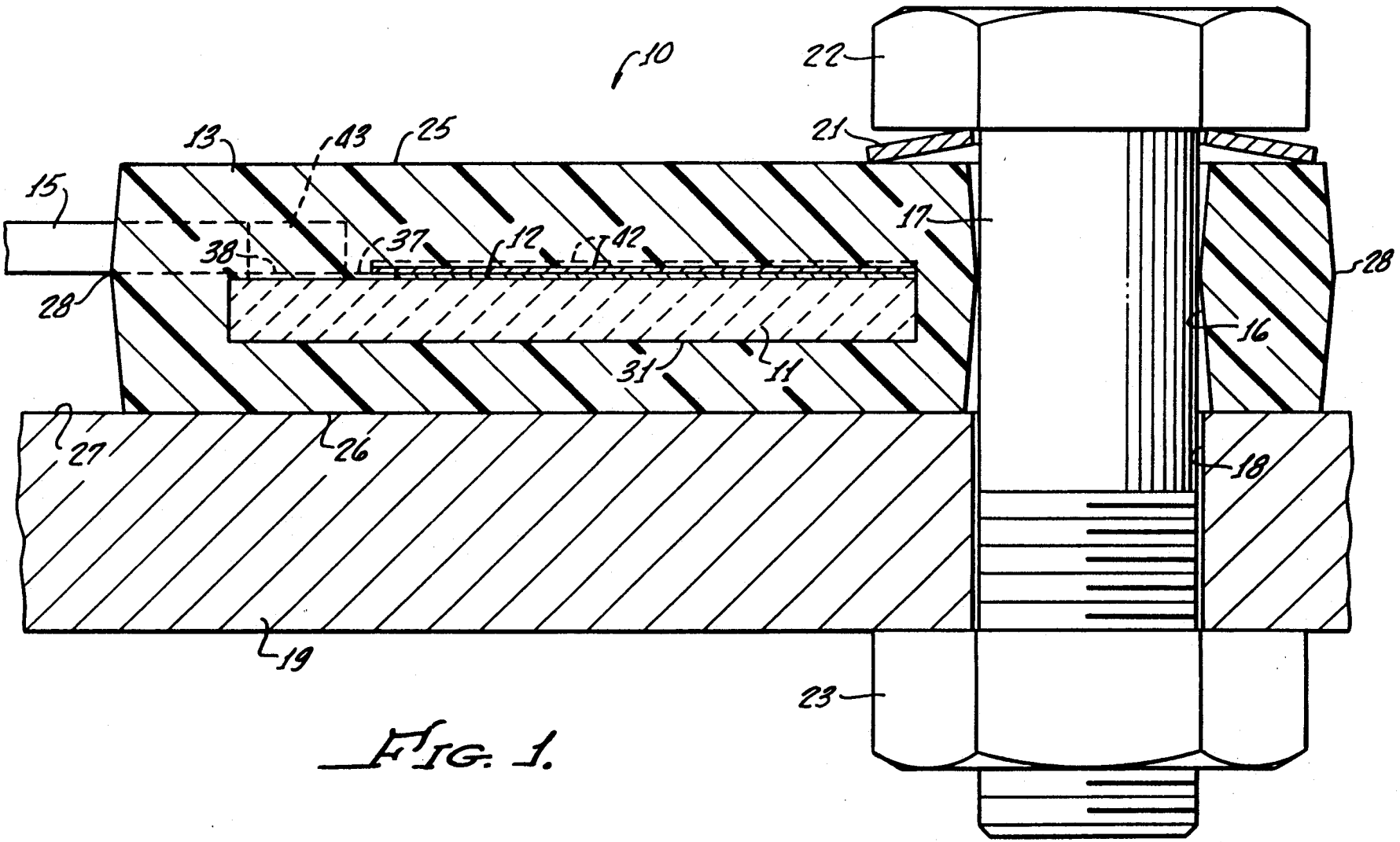
FIG. 1 is a greatly enlarged longitudinal central sectional view illustrating the combination of chip, resistive film, high thermal-conductivity synthetic resin, chassis and mounting bolt.

Referring first to FIG. 1, the resistor is indicated at 10 and comprises a substrate 11 (which may be called a "chip") on the upper side of which (FIG. 1) is provided a resistive film 12. Chip 11 is an effective electrical insulator but is a rather good thermal conductor (for a nonmetal). Chip 11 further performs the function of a spacer, because it assures that regardless of the location of elements 11,12 in surrounding synthetic resin (the resistor body) 13, film 12 will always be spaced from the underlying chassis by an amount at least equal to the thickness of the chip 11. Not only is the film thus spaced from the chassis, but so are the leads 14,15 that are fixedly connected to the upper surface of chip 11 and thus can never be any closer to the chassis than is the resistive film.

The synthetic resin 13 that forms the elongate body of the resistor is a high thermal-conductivity but electrically insulating thermosetting resin, being preferably a high thermal-conductivity epoxy resin. Portions of the body (synthetic resin) 13 extend substantial distances away from the chip (substrate/insulator/spacer), especially at the body end remote from leads 14,15. Body 13 is molded with a bolthole 16 provided in such body end. The axis of the bolthole lies in a plane perpendicular to that of chip 11. A bolt 17 extends through hole 16 and through a corresponding hole 18 in the chassis, the latter being indicated by the reference numeral 19.

A belleville spring 21 is provided around the shank of bolt 17 on the upper surface of body 13, so as to apply firm compression forcing the resistor against the flat upper surface of chassis 19 when the hexhead 22 of the bolt is cranked down so as to tighten the bolt in its associated nut 23. The spring 21 permits a desired amount of expansion of the synthetic resin forming body 13 when the body heats to a relatively high temperature.

Because body 13 is not electrically conductive, there is no need to have any insulating elements associated with any part of bolt 17. Thus, there need be no insulating washers, bushings, etc.

As shown in FIGS. 2–4, and as previously indicated, the resistor 10 employed in the best mode of the present invention is generally rectangular and elongate, having flat parallel upper and lower surfaces 25 and 26 (FIGS. 1 and 2) of body 13. As above indicated, the flat lower surface 26 is pressed into flatwise engagement with the flat upper surface 27 of chassis 19, by the bolt assembly.

The outer end surface, inner end surface, and side surfaces of the synthetic resin body 13 are not precisely perpendicular to upper and lower surfaces 25,26. Instead, they incline outwardly toward the mold parting line shown at 28. Similarly, as indicated in FIG. 1, the wall of bolthole 16 is a double frustocone, with the narrow ends of the frustoconical surfaces meeting at the parting line.

Referring to FIGS. 2 and 3, recesses 29 are formed in upper regions of synthetic resin body 13, along a transverse line that passes through hole 16, such recesses being unnecessary in the present resistor but being present because (for economy of production) the same mold cavities are preferably employed for types of resistors different from that shown and described herein.

The chip 11 of the best mode is also rectangular but is much closer to a square than is the body 13. As best shown in FIG. 4, the chip is sufficiently small that it does not extend to a point near bolthole 16; furthermore, the side edges and the inner-end edge of chip are spaced inwardly from the side and inner-end surfaces of body 13.

The flat upper surface of chip 11—bearing the resistive film—lies in substantially the same horizontal plane as parting line 28. Thus, the flat bottom surface 31 of the chip and which is parallel to the upper surface thereof, is spaced from lower surface 26 of body 13 by a distance equal to the spacing of the parting line 28 from such lower surface 26 less the thickness of the chip 11. The chip thickness is such that in normal desired production runs of the resistor 10 there is a substantial amount of the high thermal-conductivity synthetic resin between chip and body surfaces 31 and 26 (FIG. 1). Thus, the chip 11 and resistive film 12 thereon are fully encapsulated by the synthetic resin 13. However, even in an extreme situation where the chip 11 bends downwardly in the mold so that its outer-lower corner touches the bottom of the mold, the chip itself would space the resistive film 12 from chassis 19.

In the mold cavity, the chip 11 with film 12 thereon is cantilevered from the inner ends of leads or pins 14,15. Such inner ends are bonded to pads on the upper surface of chip 11 as described subsequently, so that the chip is antilevered out into the empty mold cavity prior to introduction of the synthetic resin. Leads or pins 14,15 are flat metal elements the lower surfaces of which lie on the bottom mold element that defines the mold cavity, and thus hold the chip in a predetermined position in such cavity with the resistive film at the plane of the parting line 28 (between the upper and lower mold elements) as above indicated.

However, when relatively viscous synthetic resin is introduced into the mold cavity during a transfer-molding operation, this has a tendency to move the chip 11. As above indicated, even an extreme downward movement of the chip caused by this action would not create a shorting condition because there is always the thickness of the chip 11 between resistive film 12 and chassis 19.

It is emphasized that the leads 14,15 must also be spaced from chassis 19 by a distance sufficient to achieve a required dielectric strength (dielectric-withstanding voltage). Also, it is emphasized that the lower surfaces of the leads 14,15 are electrically connected to the resistive film 12 (as described below), which means that the upper surfaces of the leads 14,15 have nothing but a relatively thin layer of synthetic resin above them.

In the illustrated best mode, the vertical (as viewed in FIG. 1) distance between leads 14,15 and upper body surface 25 is substantially less than the vertical distance between leads 14,15 and body surface 26 (the lower surface). In addition, the vertical distance from resistive film 12 to upper surface 25 is less than the vertical distance between film 12 and lower surface 26.

Despite the relatively short distance from film 12 to upper surface 25, which provides a relatively short path for thermal conduction of heat from film 12, it is not desired that the resistor 10 be turned over so that surface 25 (instead of surface 26) is pressed against chassis 19.

Applicant employs the relatively high thermal conductivity of the chip 11, in combination with the high thermal conductivity of the synthetic resin disposed between chip 11 and the chassis 19, to create effective heat transfer from film to chassis while insuring that under all conditions there is adequate spacing between the leads and the chassis and between the resistive film and the chassis.

The relatively high thermal-conductivity chip cooperates with the relatively high thermal-conductivity synthetic resin to effectively transfer heat from film 12 through both the chip and the resin to the chassis, where the heat is effectively dissipated. The result is relatively high power ratings for an economically-produced resistor, yet with effective built-in safeguards preventing shorting or arcing between film (and leads) and chassis.

To cause customers to place the surface 26 (not surface 25) in flatwise engagement with chassis 19, the surface 25 is provided with suitable indicia while the surface 26 is preferably not so provided. The indicia are preferably ink or paint, for example a trademark, but the indicia may also comprise spaced small protuberances (for example, of different heights) on surface 25.

The preferred chip is formed of ceramic, preferably aluminum oxide. Other less-preferred ceramics include beryllium oxide and aluminum nitride. The preferred high thermal-conductivity synthetic resin is ARATRONIC 2125 epoxy, available from CIBA-GEIGY Corporation, Electronic Materials, Los Angeles, Calf.

The preferred thickness of the ceramic chip is about three-hundredths of an inch, for example 0.034 inch. The preferred spacing from the bottom 31 of the chip to the bottom 26 of body 13 is also about three-hundredths of an inch, for example 0.036 inch. This latter dimension, however, varies as indicated above due to movement of the chip in the mold cavity as the viscous epoxy enters the mold cavity during transfer molding. The preferred distance from the resistive film 12 to upper surface 25 of body 13 is about five or six-hundredths of an inch, for example 0.055 inch. The preferred thickness of the leads 14,15 (vertical dimension in FIG. 1) is about two or three-hundredths of an inch, for example 0.025 inch.

Chip 11 is, in the best mode stated in the preceding paragraph, about one-third inch wide and a small amount longer. Thus, for example, the width (dimension in a direction perpendicular to leads 14,15) is 0.330 inch. The length of the chip, in a direction longitudinally of the leads, is 0.365 inch. The width of body 13 is about forty-hundredths of an inch, for example 0.410 inch. The length of such body is about sixty-hundredths of an inch, for example 0.640 inch. The bolthole 16 has a diameter of 0.125 inch approximately.

The inner edge of ceramic chip 11 is, in the best mode, spaced about 0.060 inch from the inner edge of synthetic resin body 13. The chip edge remote from the leads is spaced 0.425 inch from the inner edge of the synthetic resin body. On the other hand, the center of the bolthole is spaced 0.125 inch from the outer edge of the body. The minimum distance between the bolthole (at its region closest to the leads) and the outer edge of the chip is approximately 0.027 inch. This latter distance is somewhat less than the thickness of the ceramic chip.

Figure 5:
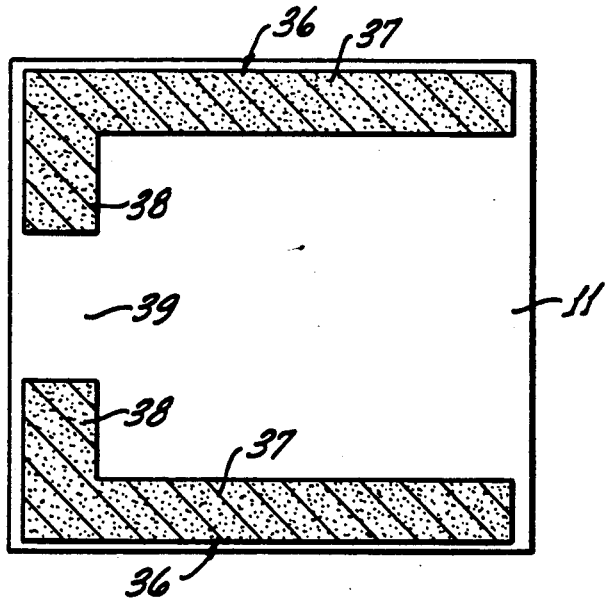
FIG. 5 is a plan view of the substrate having termination traces and pads thereon.
Figure 6:
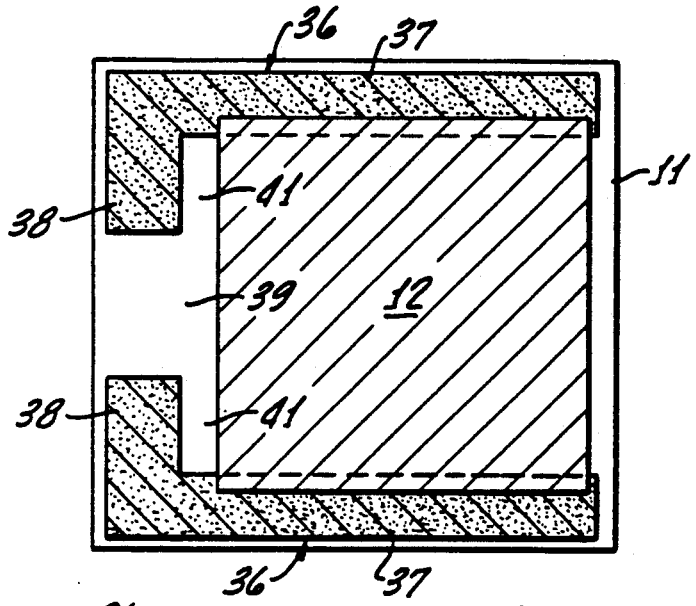
FIG. 6 is a view corresponding to FIG. 5 and also showing the resistive film.
Figure 7:
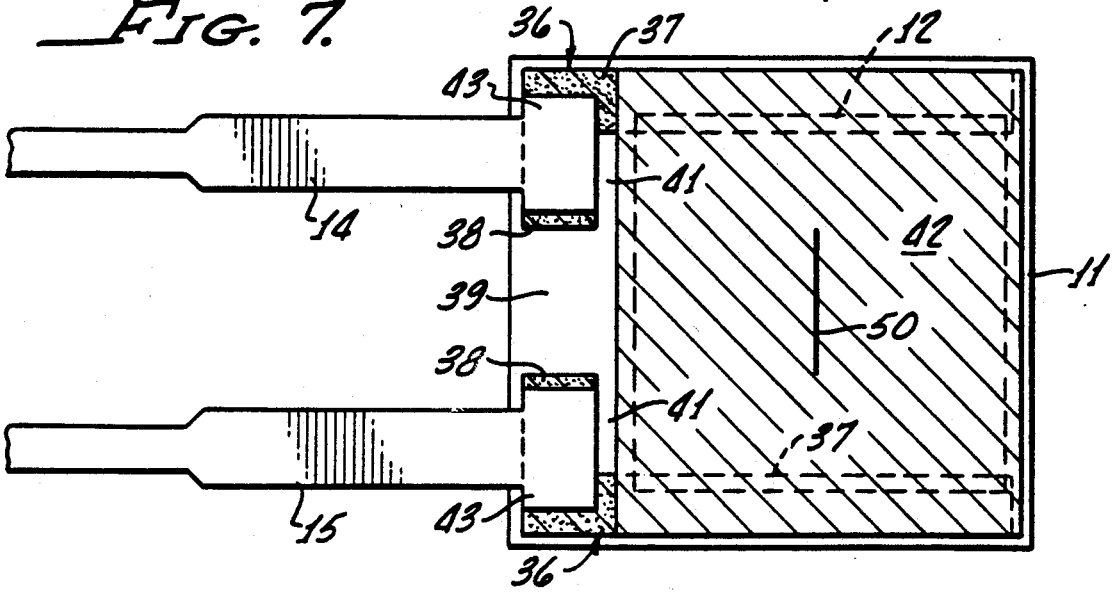
FIG. 7 is a view corresponding to FIGS. 5 and 6 and also showing the overglaze and the terminals.
Figure 8:
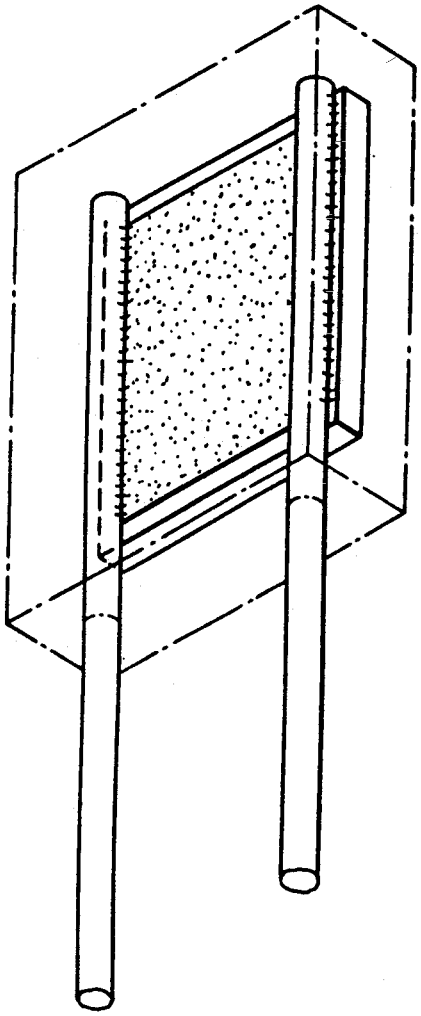
FIG. 8. (PRIOR ART)
FIG. 8 is an isometric view showing prior art only.

Referring to FIGS. 5–7, during manufacture of the resistor 10 there are screen-printed onto the upper side of chip 11 two metallization traces 36. Each of these comprises a termination strip 37 that connects to a pad 38. As shown, each strip-pad combination is generally L-shaped, with the pads extending towards each other and being separated from each other by a substantial gap 39. The outer edges of the strip-pad combinations are parallel to and spaced short distances inwardly from the extreme edges of chip 11, as shown. The metallizations are applied and fixed before application of films as described below.

Referring particularly to FIG. 6, the resistive film 12 is screen-printed onto the same side of chip 11, with the side edge portions of the film 12 overlapping and in contact with inner edge portions of termination strips 37. The deposited resistive film 12 is, in the example, substantially square. The edges of film 12 nearest pads 38 are spaced therefrom at gaps 41. The edge of film 12 remote from gaps 41 is spaced inwardly from the corresponding edge of chip 11, the spacing being somewhat more than the spacing of the ends of termination strips 37 from such edge.

As shown in FIG. 7, a coating 42 is provided over resistive film 12, being preferably a layer of fused glass (overglaze). Along the edge of resistive film 12 adjacent gaps 41, the overglaze 42 extends beyond the resistive film, occupying an elongate area at the edges of gaps 39 and 41. The overglaze is also applied to the chip 11 along the edge remote from gaps 39 and 41, as shown at the right in FIG. 7.

The termination strip-pad combinations are, for example, a palladium-silver metallization deposited by screen-printing and then fired. Thereafter, the resistive film 12 is applied by screen-printing, this film being a thick film composed of complex metal oxides in a glass matrix. After deposition of the resistive film, it is fired at a temperature in excess of 800 degrees C. The overglaze 42 is a relatively low-melting-point glass frit that is screen-printed onto the described areas after firing of the resistive film, following which the overglaze is fired at a temperature of about 500 degrees C. The distinct difference in firing temperatures between the film 12 and the overglaze 42 means that the overglaze will not adversely affect the film. The overglaze 42 prevents the high thermal-conductivity molded body 13 from adversely affecting the film 12.

The pads 38 are screen-printed with solder, following which the inner ends 43 of leads 14,15 are located and clamped thereon. Then, the combination is baked in order to melt the solder and complete the soldering operation, thus securing the leads effectively to the pads and thus to the chip. The solder employed is preferably 96.5% tin and 3.5% silver.

The leads 14,15 are connected into an electrical circuit and the resistor is trimmed to the desired degree of resistivity. This is preferably done by laser-scribing a slot or line 50 as shown in FIG. 7, the size of the slot being adjusted in order to achieve the desired resistance value.

Stated more definitely, slot 50 is cut through the resistive film 12, and is made progressively wider until the resistance value of the resistor is as desired.

It is emphasized that slot 50 is parallel to the direction of current flow. The termination strips 37 are parallel to each other, and slot 50 is made perpendicular to such strips. Current flows directly between the termination strips and perpendicular to them. Accordingly, current flow through the resistive film is parallel to slot 50.

By making slot 50 parallel to such current flow, important benefits are achieved vis-a-vis obtaining uniformly high current density, and high power-handling capability.

After chip 11 and the associated films and leads are manufactured and connected as described, the high thermal-conductivity synthetic resin (the preferred type of which is stated above) is provided in powder form, heated, and then introduced into the mold cavity in viscous condition by transfer molding.

The words "high thermal-conductivity synthetic resin" denote a thermosetting synthetic resin which is an electrical insulator and has a thermal conductivity of at least about 0.9, and preferably at least 2.5, W/m K (watts per meter per degree Kelvin).

The foregoing detailed description is to be clearly understood as given by way of illustration and example only, the spirit and scope of this invention being limited solely by the appended claims.

What is claimed is:

1. A film-type electrical power resistor, which comprises:

(a) a flat chip formed of a substance that is electrically insulating and has substantial thermal conductivity, said chip having an upper side and a lower side, (b) a resistive film applied to said upper side of said chip, (c) leads bonded to said upper side of said chip and electrically connected to said film on said upper side of said chip, said leads being adapted to cantilever said chip with said film thereon in a mold cavity, during manufacture of the power resistor, prior to introduction of synthetic resin into said mold cavity, with said lower chip side spaced above the bottom wall of said cavity, and (d) a molded body molded in said mold cavity and substantially fully encapsulating said chip, said film, and the inner ends of said leads, said molded body having a flat bottom surface, said molded body not having any mold cup therearound, said molded body being formed of a high thermal-conductivity synthetic resin, said molded body having a bolthole therethrough for clamping of said resistor in effective heat-transfer relationship to a flat surface of a chassis or heatsink, the space between said lower side of said chip and said flat bottom surface of said molded body being a heat-sinking volume formed of said high thermal-conductivity resin, the bottom surface of said volume of resin being the bottom surface of the resistor, said volume not containing any metal layer that is either in an electric circuit or projects outwardly relative to the edges of said chip.

2. The invention as claimed in claim 1, in which said resin is high thermal-conductivity epoxy.

3. The invention as claimed in claim 1, in which said chip substance is a ceramic.

4. The invention as claimed in claim 3, in which said ceramic is aluminum oxide.

5. The invention as claimed in claim 2, in which said chip is formed of aluminum oxide ceramic.

6. A power resistor combination, which comprises:

(a) a flat chassis or heatsink region having a bolthole therethrough, (b) a flat chip formed of a substance that is electrically insulating and has substantial thermal conductivity, said chip having an upper side and a lower side, (c) a resistive film applied to said upper side of said chip, (d) leads bonded to said upper side of said chip and electrically connected to said film on said upper side of said chip, said leads being such that said chip with said film thereon may be cantilevered by said leads in a mold cavity, during manufacture of the power resistor, prior to introduction of synthetic resin into said mold cavity, with said lower chip side spaced above the bottom of said cavity, (a) a molded body molded in said mold cavity and substantially fully encapsulating said chip, said film, and the inner ends of said leads, said molded body being formed of a high thermal-conductivity synthetic resin, said molded body not having any mold cup therearound, said molded body having a bolthole therethrough for clamping of said resistor to a chassis or heatsink, said molded body having a flat surface generally parallel to said chip and on the side of said chip that is relatively remote from said resistive film, said flat surface of said molded body being disposed in flatwise engagement with said flat chassis or heatsink region, whereby heat from said film passes through said chip and through part of said body in order to reach said flat surface of said body and thus said chassis or heatsink region, and (f) a bolt extended through said boltholes in said body and chassis or heatsink region to maintain said flat surface of said body in high-thermal-conductivity engagement with said flat chassis or heatsink region, and the space between the bottom surface of said chip and said flat bottom surface of said molded body being a heat-sinking volume formed of said high thermal-conductivity resin, the bottom surface of said volume of resin being said flat surface of said body and being the bottom surface of the resistor, said volume not containing any metal layer that is either in an electric circuit or projects outwardly relative to the edges of said chip.

7. The invention as claimed in claim 6, in which said resin is high thermal-conductivity epoxy.

8. The invention as claimed in claim 6, in which said chip substance is a ceramic.

9. The invention as claimed in claim 8, in which said ceramic is aluminum oxide.

10. The invention as claimed in claim 8, in which said chip is aluminum oxide ceramic.

11. A film-type power resistor, which comprises:

(a) an elongate thin rectangular molded body formed of high thermal conductivity synthetic resin, said body having flat upper and lower surfaces that are substantially parallel to each other, said body having a bolthole therethrough at a location relatively near one end of said body and extending in a direction perpendicular to said surfaces, said body not having any mold cup therearound, (b) a flat ceramic chip embedded in said molded body and substantially parallel to said upper and lower surfaces, said chip being between said bolthole and the other end of said body, said chip not being present in or around the portion of said body through which said bolthole extends, said chip being spaced below said upper surface and spaced above said lower surface, (c) termination traces and pads adhered to the upper surface of said ceramic chip, (d) a resistive film adhered to said upper surface of said ceramic chip and also adhered to said termination traces, and (e) leads having inner portions overlapping said chip and conducively bonded to said pads, outer portions of said leads projecting out of said body in parallel relationship to each other, said leads being such that said chip with said film thereon may be cantilevered by said leads in a mold cavity, during manufacture of the power resistor, prior to introduction of synthetic resin into said mold cavity, with the lower surface of said chip spaced above the bottom of the cavity, the space between said lower surface of said chip and said flat lower surface of said molded body being a heat-sinking volume formed of said high thermal-conductivity resin, the bottom surface of said volume of resin being said flat lower surface of said body, said volume not containing any metal layer that is either in an electric circuit or projects outwardly relative to the edges of said chip.

12. The invention as claimed in claim 11, in which said resin is high thermal-conductivity epoxy and said ceramic chip is aluminum oxide ceramic, said epoxy having a thermal conductivity of about 2.5 W/m K.

13. The invention as claimed in claim 11, in which said resistive film is screen-printed thick film.

14. The invention as claimed in claim 11, in which the upper surface of said chip is spaced farther from said lower surface of said body than from said upper surface of said body.

15. The invention as claimed in claim 11, in which said resin is high thermal-conductivity epoxy and said ceramic chip is aluminum oxide ceramic, the upper surface of said chip being spaced farther from said lower surface of said body than from said upper surface of said body.

16. The invention as claimed in claim 11, in which a flat external metal or heatsink region is provided and has a bolthole therethrough, in which said lower surface of said body is mounted in flatwise engagement with said chassis region, and in which a bolt is extended through both of said boltholes to maintain said lower surface of said body in high heat-transfer relationship to said chassis region, whereby heat from said film passes through said chip and the body portion therebeneath to said lower body surface and thus to said chassis region.

17. The invention as claimed in claim 11, in which said resin is high thermal conductivity epoxy and said ceramic chip is aluminum oxide ceramic, the upper surface of said chip being spaced farther from said lower surface of said body than from said upper surface of said body, in which a flat metal chassis region is provided and has a bolthole therethrough, in which said lower surface of said body is mounted in flatwise engagement with said chassis region, and in which a bolt is extended through both of said boltholes to maintain said lower surface of said body in high heat transfer relationship to said chassis region, whereby heat from said film passes through said chip and the body portion therebeneath to said lower surface and thus to said chassis region.

18. The invention as claimed in claim 13, in which said resistive film is a substantially solid film, in which a trimming slot is provided through said resistive film, in which said termination traces are substantially parallel to each other, and in which said trimming slot is substantially perpendicular to said termination traces, whereby said trimming slot is parallel to the direction of current follow through said resistive film between said termination traces, and in which there is no substantial trimming slot or slot portion in said film that is not substantially perpendicular to said termination traces.

19. The invention as claimed in claim 18, in which a barrier coating is provided over said resistive film, between it and said high thermal-conductivity synthetic resin body, to prevent said synthetic resin body from adversely affecting said resistive film.

20. The invention as claimed in claim 19, in which said barrier coating is glass having a firing temperature much lower than that of said resistive film.

* * * * *